United States Patent [19]

Beehler

[11] Patent Number: 4,858,683

[45] Date of Patent: Aug. 22, 1989

[54] STAMPED DISCHARGE GRILLE INCLUDING TWO LOUVRED SECTIONS

[75] Inventor: Richard F. Beehler, Franklin, Tenn.

[73] Assignee: Heil-Quaker Corporation, Lavergne, Tenn.

[21] Appl. No.: 176,868

[22] Filed: Apr. 4, 1988

[51] Int. Cl.[4] ..... F24B 1/06

[52] U.S. Cl. ..... 165/125; 165/122; 62/507; 62/285; 415/219.1

[58] Field of Search ..... 165/134.1, 122, 76, 165/125, 73, 74; 62/506, 507, 508, 428, 455, 450; 415/219 R; 417/360, 424 R, 423 R; 416/247 R

[56] References Cited

U.S. PATENT DOCUMENTS

| | | |
|---|---|---|
| 1,872,785 | 8/1932 | Modine . |
| 1,921,466 | 8/1933 | Holle . |
| 1,946,885 | 2/1934 | Schmidt et al. . |
| 1,974,317 | 9/1934 | Steenstrup . |
| 2,004,993 | 6/1935 | Karsel et al. . |
| 2,055,528 | 9/1936 | Greene . |
| 2,087,160 | 7/1937 | Meyerhoefer . |
| 2,115,720 | 5/1938 | Holmes . |
| 2,134,649 | 10/1938 | Will et al. . |
| 2,143,919 | 1/1939 | Kotterman . |
| 2,174,654 | 10/1939 | Fink . |
| 2,185,484 | 1/1940 | Welch et al. . |
| 2,225,985 | 12/1940 | Fink . |
| 2,256,006 | 9/1941 | Zeller et al. . |
| 2,371,360 | 3/1945 | Silverberg . |
| 2,478,137 | 8/1949 | Timmer . |
| 2,532,288 | 12/1950 | Buschow . |
| 2,564,258 | 8/1951 | Herbster . |
| 2,584,982 | 2/1952 | Burke . |
| 2,589,262 | 3/1952 | Keith . |
| 2,598,763 | 6/1952 | Roo . |
| 2,703,701 | 3/1955 | Simpelaar . |
| 2,722,810 | 10/1955 | Maniscalco, Sr. . |
| 2,736,176 | 2/1956 | Carlton . |
| 3,115,757 | 12/1963 | Day . |
| 3,504,617 | 4/1970 | Merklin et al. . |
| 3,612,173 | 10/1971 | Goyal . |
| 3,833,053 | 9/1974 | Benteler et al. . |
| 3,865,517 | 2/1975 | Simmons et al. . |
| 3,870,860 | 3/1975 | Steiner . |
| 4,034,204 | 7/1977 | Windsor et al. . |
| 4,036,292 | 7/1977 | Hine, Jr. . |
| 4,043,708 | 8/1977 | Greenfield . |
| 4,103,146 | 7/1978 | Rampe . |
| 4,171,937 | 10/1979 | Greenfield . |
| 4,202,409 | 5/1980 | Cann et al. . |
| 4,321,803 | 3/1982 | Smith . |
| 4,337,823 | 7/1982 | DelPercio . |
| 4,340,115 | 7/1982 | Wright et al. . |
| 4,392,525 | 7/1983 | O'Mara et al. ..... 62/507 X |
| 4,394,111 | 7/1983 | Wiese et al. . |
| 4,475,585 | 10/1984 | Hoeffken . |
| 4,502,291 | 3/1985 | Shetton et al. ..... 415/219 R |
| 4,723,419 | 2/1988 | Kessler et al. ..... 62/507 |

*Primary Examiner*—Larry Jones

*Attorney, Agent, or Firm*—Jeffers, Hoffman & Niewyk

[57] ABSTRACT

A cover for an air conditioner condenser unit which is formed from a single unitary sheet of material. The cover includes a peripheral portion, a central portion, and an unbroken ring portion located intermediate the peripheral and central portions. The peripheral, central and ring portions are generally coplanar. A first set of louvres interconnects the central portion and the ring portion. A second set of louvres connects the ring portion and the peripheral portions. The angle of inclination of the louvres with respect to the plane of the cover varies over the length of the louvres.

18 Claims, 3 Drawing Sheets

STAMPED DISCHARGE GRILLE INCLUDING TWO LOUVRED SECTIONS

BACKGROUND OF THE INVENTION

This invention relates to heat exchanger units for central air conditioning systems, heat pumps and the like. More particularly this invention relates to cabinets for such heat exchanger units and specifically to louvred tops therefor.

Central air conditioning or heat pump systems for residential and light commercial use generally employ a condenser unit located outside and an evaporator unit located inside the space whose temperature is to controlled. The condenser unit includes a compressor, a heat exchanger, appropriate valves and piping, and a fan and electric motor for driving the fan to move air over the heat exchanger. Typically, these components are housed in a cabinet having an apertured top through which the fan expels air out of the cabinet after it is drawn into the cabinet and is blown over the heat exchanger.

It is very important for the proper operation of an air conditioning or heat pump system that heat be efficiently transferred by the heat exchanger located in the condenser unit. Thus, it is very important for the proper operation of the system that the apertured top of the condenser housing permits air to flow out of the cabinet in sufficient quantities and with negligible pressure loss. Further, it is important in these types of systems that, during shipment from the factory to the residence, the units not be damaged and that the alignment of the fan with the air inlet opening in the top of the cabinet be properly maintained.

The cabinet tops or covers for prior art air conditioning condenser units have typically included an aperture which was covered by a wire or plastic grille to meet industry standards and agency requirements. Further, these arrangements prevent debris such as leaves, twigs and the like from entering the cabinet and causing damage to the internal structure of the unit. However, removal of material to form an aperture in the cover of such prior art units and disposing of such removed material was wasteful. It is therefore desired to eliminate the need for removing material in forming cabinet tops.

Another problem with prior art cabinet arrangements has been the mounting of the motor. In several prior art arrangements, the motor mounting bracket has been secured directly to the cabinet top. However, these prior art arrangements have not been satisfactory as the motor mounting arrangements were rather complicated and expensive and furthermore caused undue vibration which was transmitted to the cabinet, thereby causing undesirable noise and potential loosening of fasteners, etc.

Some prior art condenser tops have been provided which have been formed from a single sheet of material such as cold rolled steel. However, in these systems, the size of the top is limited due to the inherent flexibility of the material and due to the fact that by providing stamped louvres in such a top, the top was weakened. Furthermore, if the louvres were oriented radially outwardly from the center of the cover, the length of such louvres was limited because the open spaces provided between the louvres at the peripheral edge of the top are limited by agency requirements to no more than ½ inch in width. Therefore, the length of such louvres was limited, thereby limiting the overall size of the cover which could be provided by such arrangements. Further, by suspending a fan and fan motor directly from such stamped unitary tops, undesirable vibrations were set up in the cabinet thereby making such systems undesirable. It is therefore desired to provide a louvred cabinet top with a maximum total open louvred area in order to minimize resistance to air flow. It is also desired to provide such a structure which is dimensionally stable.

It is also desired to provide a unitary louvred top for an air conditioner condenser unit which is strong, is not subject to undue vibration and has a minimum resistance to air flow.

SUMMARY OF THE INVENTION

The present invention, in one form thereof, overcomes the disadvantages of the above described prior art cabinet covers for heat exchanger cabinets by providing an improved heat exchanger cabinet cover therefor. The heat exchanger cabinet cover of the present invention is formed from a unitary sheet of material and includes two sections of louvres which are separated by a generally unbroken ring of material. The fan motor is suspended from the ring of material.

The heat exchanger cabinet cover, according to the present invention, includes a generally planar central portion, a generally planar peripheral portion and a generally planar ring portion located intermediate the peripheral and central portions. The first set of louvres is located between the peripheral portion and the ring portion. A second set of louvres is located between the central section and the ring portion. Both sets of louvres are arranged to extend lengthwise radially outwadly with respect to the central portion of the cover. The outer set of louvres are generally longer than the inner set of louvres. The motor is suspended from the ring portion by means of a wire bracket.

One advantage of the present invention is that the cover is stronger and more dimensionally stable than prior art air conditioner condenser cabinet covers by the provision of a planar ring of material intermediate the two sets of louvres. Furthermore, since the cover is stronger than the prior art covers, the cover can be made larger for accommodation of larger air conditioner condenser units than was possible with prior art covers. By the proper orientation of the ring of material and the dimensioning of the motor mounting structure, the top may be detuned from the system frequencies, thereby keeping vibrations at a minimum. Further, by the proper rotational orientation of the louvres in relation to the airflow pattern and by arranging for the proper angle for the louvres, efficiency of airflow is maximized.

Another advantage is that by suspending the motor mount from the planar ring, a strong support system is provided which minimizes the generated vibrations of the fan and motor.

Still another advantage of the cover according to the present invention is that it is less costly to manufacture than prior art cabinet covers because no material is discarded by the provision of an aperture in the cover since the material of the cover is cut and bent to form louvres.

A still further advantage is that the number of parts utilized to form the cover as well as the processing operations, are reduced, thereby resulting in labor and cost savings.

Yet a further advantage of the invention is that the louvres provide shading for the interior of the cabinet thus protecting plastic and rubber components from ultraviolet light and resultant damage.

The present invention, in one form thereof, comprises a cover for a heat exchanger cabinet having a peripheral generally planar portion, a generally planar central portion and a generally planar ring portion located intermediate the peripheral and central portions. The central, peripheral and ring portions are substantially coplanar. A first plurality of lengthwise radially oriented louvres connect the peripheral and ring portions. A second plurality of lengthwise radially oriented louvres connect the ring portion and the central portion.

The invention, in one form thereof, further comprises a cover for a heat exchanger assembly, wherein the assembly includes a housing having a plurality of upstanding sides, a heat exchanger coil arranged in the housing, a fan arranged to move air over the coil, and a motor for driving the fan. The cover includes a peripheral generally planar portion, a generally planar central portion and a planar ring portion located intermediate the peripheral and central portions. The peripheral, central and ring portions are generally coplanar. A plurality of first lengthwise radially oriented louvres connect the peripheral portion with the ring portion. A plurality of lengthwise radially oriented second louvres connect the central portion to the ring portion. The peripheral portion, ring portion and central portion and the pluralities of first and second louvres are formed from a single unitary sheet of material.

The invention, in one form thereof, still further comprises a cover for a heat exchanger assembly wherein the assembly includes a housing having a plurality of upstanding sides, a heat exchanger coil arranged in the housing, a fan to move air over the coil, and a motor for driving the fan. The cover includes a peripheral generally planar portion, an unbroken general planar central portion and a generally planar ring portion located intermediate the peripheral and central portions. The peripheral, central, and ring portions are substantially coplanar. A plurality of lengthwise radially oriented first louvres connect the peripheral portion with the ring portion. A plurality of lengthwise radially oriented louvres connect the central portion with the ring portion. The peripheral, ring and central portions and the pluralities of first and second louvres are formed from the same sheet. The first louvres are longer than the second louvres.

It is an object of the present invention to provide an efficient, dimensionally stable and strong cover for an air conditioner condenser.

It is another object of the present invention to provide an air conditioner condenser cabinet cover which may be made in larger sizes than was previously possible.

A still further object of the present invention is to provide an air conditioner condenser cabinet cover which may be detuned from the generated frequencies of the system.

A yet further object of the present invention is to provide a unitary cover for an air conditioner condenser cabinet which is relatively low in cost to manufacture and which results in the elimination of scrap.

BRIEF DESCRIPTION OF THE DRAWINGS

The above mentioned and other features and objects of this invention and the manner of attaining them will become more apparent and the invention itself will be better understood by reference to the following description of an embodiment of the invention taken in conjunction with the accompanying drawings wherein.

Corresponding reference characters indicate corresponding parts throughout the several views of the drawings.

The exemplification set out herein illustrates a preferred embodiment of the invention, in one form thereof, and such exemplification is not to be construed as limiting the scope of the disclosure or the scope of the invention in any manner.

DETAILED DESCRIPTION OF THE PREFERRED EMBODIMENT

Figure 1:
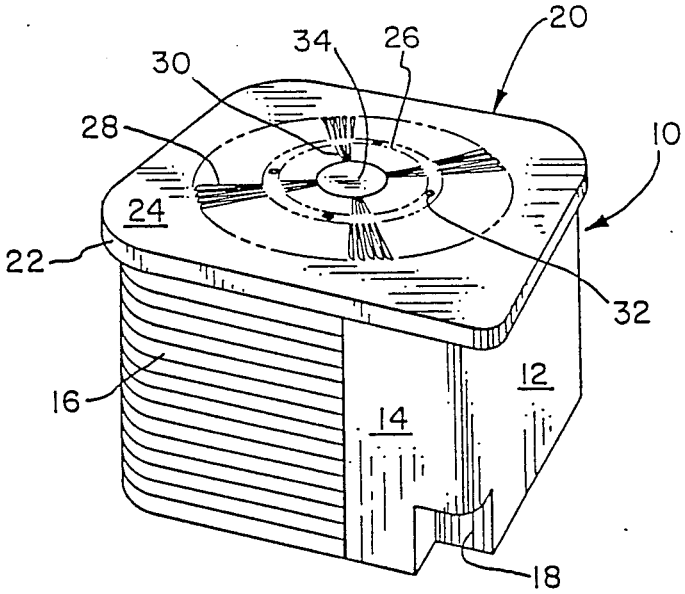
FIG. 1 is a perspective view of an air conditioner condenser unit.
Figure 3:
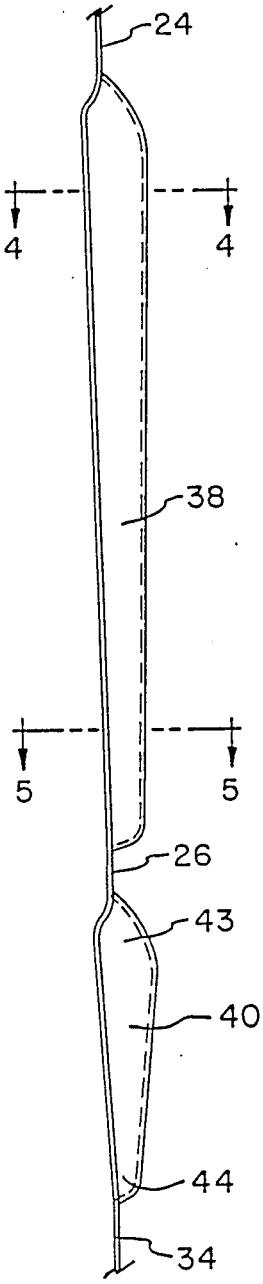
FIG. 3 is an enlarged partial sectional view of the louvre of the cover of FIG. 2 taken along line 3—3 thereof.

Referring to FIG. 1, there is shown a perspective view of an air conditioner or heat pump condensing unit which would normally be located outside the space whose temperature is to be controlled, such as a residence. The unit includes a cabinet having a bottom and four upstanding walls, two of which are indicated at 12 and 14. A grille 16 is also provided as part of the upstanding walls through which air may be discharged. Inside the cabinet are provided a compressor, a heat exchanger coil, and a motor driven fan for drawing air over the heat exchanger to increase the rate of heat exchange. Various electrical and conduit connections must be made to the compressor and heat exchanger and this is provided for by a space 18 located in one corner of the unit wherein these connections may be made. A top or cover 20 is provided for the cabinet. This top includes louvred openings through which air is discharged by the fan after the air is drawn in through the grille and over the heat exchanger coil.

Figure 2:
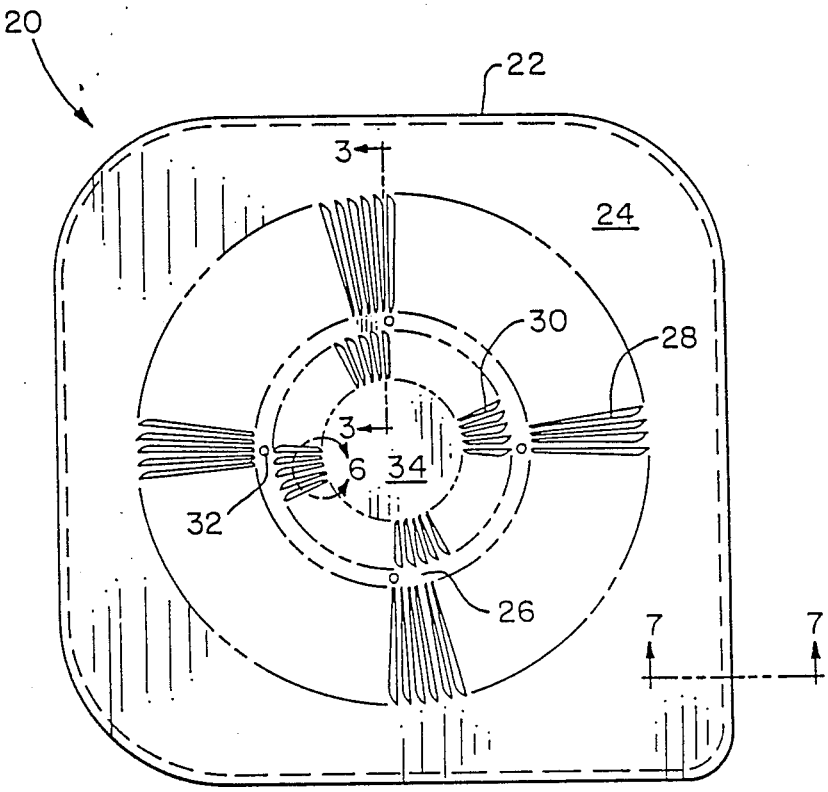
FIG. 2 is a top plan view of the cover for the condenser cabinet of FIG. 1.

FIG. 2 shows the cover 20 in greater detail. The cover 20 includes an upstanding edge 22 which fits over the upstanding sides of the cabinets 12 and 14. A planar peripheral portion 24 is provided together with a generally unbroken central planar section 34. Intermediate unbroken central section 34 and peripheral portion 24 there is located a planar ring portion 26. It should of course be understood that while the shape of the cover and cabinet is shown as being generally square, any desired shape could be provided, such as rectangular, round and the like. Furthermore, it should be understood as well, that ring portion 26 which is shown as being circular, could be made in various shapes. It should also be noted that the entire cover 20 is formed from a single planar sheet of material.

Figure 4:
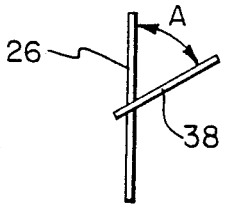
FIG. 4 is a cross sectional view of the louvre of FIG. 3 taken along line 4—4 thereof.
Figure 5:
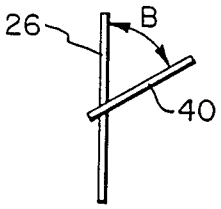
FIG. 5 is a cross sectional view of the louvre of FIG. 3 taken along line 5—5 thereof.
Figure 6:
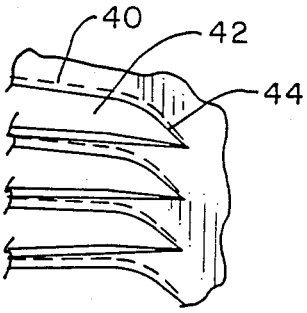
FIG. 6 is an enlarged detailed view of the section showing the roots of several louvres identified by circular line 6 in FIG. 2.

Referring further to FIG. 2 and to FIGS. 3–7, cover 20 is provided with two louvred sections 28 and 30. The louvres of section 28 connect the peripheral portion 24 with the ring-like portion 26. The louvres of section 30 connect the ring-like portion 30 with the central portion 34. The louvres are struck from the sheet-like material by forming cuts in the material and bending the louvres at an angle with respect to the plane of the cover as best seen in FIGS. 3–6. Thus by referring to FIG. 6, it can be seen that louvres 40 are bent in such a way that apertures 42 are generated between adjacent louvres. The head portions 43 and root portions 44 of louvres 40 connect louvres 40 respectively to ring portion 26 and to central portion 34. Similarly, for louvres 38 of louvred section 28, the louvres are bent at a angle with respect to the plane of the cover whereby the root and head portions of louvres 38 interconnect ring 26 and peripheral portion 24. By bending the louvres at an angle with respect to the plane of the cover, the louvres add strength and rigidity to the cover. The angle of inclination of louvres 38 and 40 varies over the length of the louvres. Thus, as seen in FIGS. 4 and 5, the respective angles A and B between the plane of ring 26 and louvre 38 are different at the head and root portions respectively of the louvre. Angle A, in the disclosed embodiment, is 125° and angle B is 117°. However these angles may be selected as desired for a particular cover arrangement. The variation in the angle improves the air flow through the top and decreases the resistance to airflow through the top.

As further seen hereinafter, an axial flow fan tends to generate the highest air velocities at the tips of the fan blades which is the radial outermost portion of the fan and is furthest removed from the central portion 34. Therefore, an optimum angle of the louvre produces a minimum resistance to the airflow pattern and improves the efficiency of the system.

It should also be noted that the spaces 42, by the provision of two sets of louvres, may be restricted to a desired size without restricting the size of the cover. Thus, if it is desired that the opening 42 is restricted to a maximum of ½ inch at its greatest width, by providing ring 26 at a desired location to break up the louvred portion of the top into two sections, this restriction in the width of opening 42 may be accommodated. It should, of course, be understood that more than one ring 26 may be provided if the top is desired to be even larger for larger cabinets.

Each of the louvres 38 and 40 in respective sections 28 and 30 are identical in shape and size. That is to say all of the louvres 40 in section 30 are identical and all of the louvres 38 in section 28 are identical. It should be noted that the louvres 38 in section 28 are longer than the louvres 40 in section 30. This results from the desire to maintain the widest opening in the top to ½ inch, to provide an aesthetically pleasing appearance of the top and to create a planar ring in order to provide a strong, dimensionally stable top.

Figure 7:
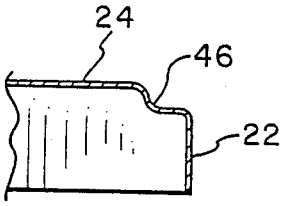
FIG. 7 is an enlarged cross sectional view of the edge of the cover of FIG. 2 taken along line 7—7 thereof.

As shown in FIG. 7, cover 20 has an upstanding edge 22, and the edge is connected to a peripheral planar portion 24 by means of an indented cover area 46. This indented area gives the top further strength.

Figure 8:
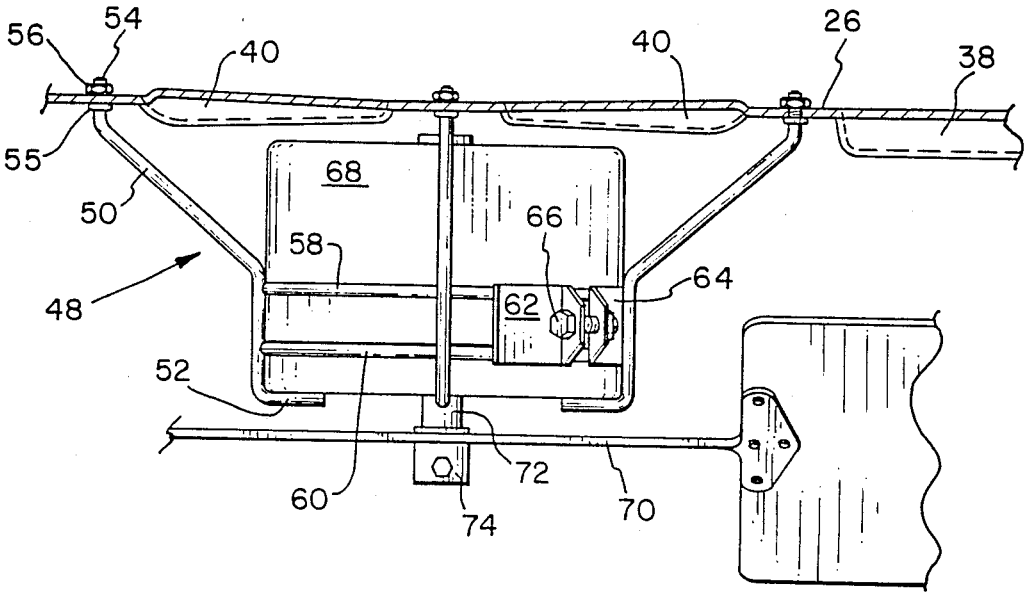
FIG. 8 is an elevational view of the motor and its mounting bracket assembled to the top of FIG. 2.
Figure 9:
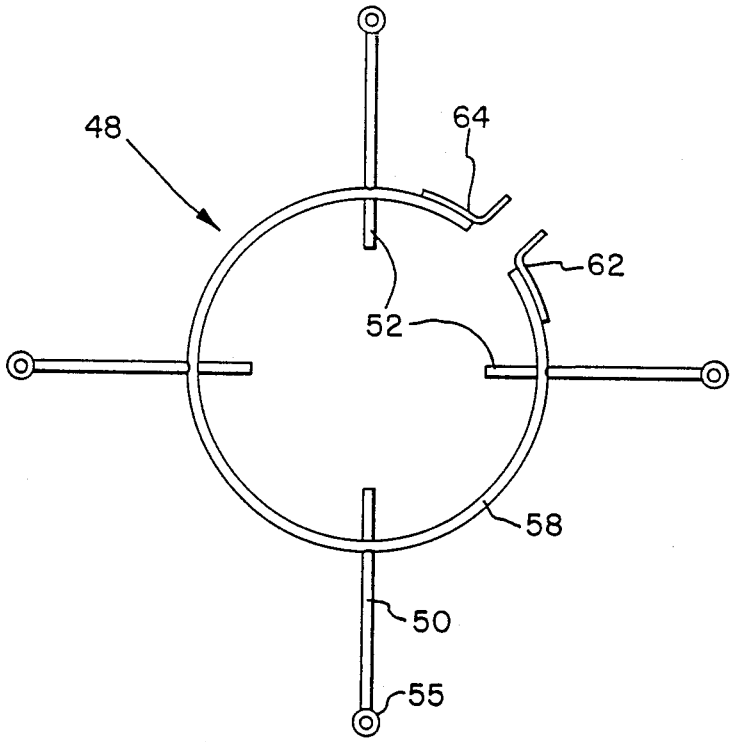
FIG. 9 is a top plan view of the motor mounting bracket of FIG. 8.

As shown in FIGS. 8 and 9, a motor mounting bracket 48 is suspended from cover 20, and in particular from the ring portion 26 thereof. The bracket is formed from wire and has four (4) upright portions 50 to which are connected bent portions 52 for supporting a motor 68. Uprights 50 also include threaded ends 54 and upset portions 55 whereby nuts 56 may be threaded on threaded ends 54 to suspend the bracket 48, motor 68, and a fan 70 from cover 20. Two ring portions 58 and 60 interconnect uprights 50 and are secured thereto by means of spot welding or the like. Motor shaft 72 has an adapter 74 connected thereto for mounting the fan 70.

The entire cover structure is detuned from the system generated frequencies. The primary motor frequency, for 110 volt systems, is normally 120 hz. Thus the entire structure is detuned to resonate at a frequency higher than 120 hz. Such detuning is accomplished by proper selection of the dimensions of the motor mounting bracket and by proper placement of ring 26. Further, detuning is accomplished by the manner of manufacturing the cover 20. The material of the cover is initially placed in tension by coining the metal upwardly so as to form a slight bubble in the material which relaxes the metal. The louvred sections are then formed in appropriate dies, and are therefore formed in a relaxed area of the metal, thereby causing the cover 20 to assume the generally planar configuration whereby peripheral portion 24, ring portion 26 and central portion 34 are substantially coplanar. It should be understood that the cover may be formed of other materials, for instance, plastic.

What has therefore been provided is a very economical and advantageous cover for a central air conditioning cabinet for efficient flow of air therethrough and for a minimum amount of vibration transmission from the motor to the cabinet.

While this invention has been described as having a preferred design, it will be understood that it is capable of further modification. This application is therefore intended to cover any variations, uses, or adaptations of the invention following the general principles thereof and including such departure from the present disclosure as come within known or customary practice in the art to which this invention pertains and fall within the limits of the appended claims.

What is claimed is:

1. A cover for a heat exchanger cabinet, said cabinet including a plurality of generally upstanding sides and having a heat exchanger coil, fan, and motor for driving said fan disposed therein, said cover comprising a peripheral generally planar portion, a generally planar central portion, and a generally unbroken planar ring portion located intermediate said peripheral portion and said central portion, said central, peripheral, and ring portions being substantially coplanar;

a plurality of length wise radially oriented first louvres connecting said peripheral portion with said ring portion;

a plurality of lengthwise radially oriented second louvres connecting said ring portion with said central portion.

2. The cover according to claim 1 wherein said peripheral portion, ring portion, and central portion and said plurality of first and second louvres are all formed from a unitary sheet.

3. The cover according to claim 1 including a motor support bracket secured to said ring portion for supporting said fan driving motor.

4. The cover according to claim 3 wherein said cover and motor support bracket are detuned from the frequencies generated by the system.

5. The cover according to claim 1 wherein the angle of inclination of the planes of the first louvres and second louvres with respect to the plane of said cover vary along the length of said louvres.

6. The cover according to claim 1 wherein the first and second louvres are of uniform shape.

7. The cover according to claim 1 wherein the first louvres are longer than the second louvres.

8. A cover for a heat exchanger assembly, said assembly including a housing having a plurality of upstanding sides, a heat exchanger coil arranged in said housing, a fan arranged to move air over said coil, and a motor for driving said fan, said cover comprising;

a peripheral generally planar portion, a generally planar central portion, and a generally planar unbroken ring portion located intermediate said peripheral portion and central portion, said peripheral portion, central portion, and ring portion being generally coplanar;

a plurality of first lengthwise radially oriented louvres connecting said peripheral portion with said ring portion;

a plurality of lengthwise radially oriented second louvres connecting said central portion with said ring portion;

said peripheral portion, ring portion, central portion, and pluralities of first and second louvres being formed from a single unitary sheet.

9. The cover according to claim 8 including a motor support bracket secured to said ring portion for supporting said fan driving motor.

10. The cover according to claim 9 wherein said cover and motor support bracket are detuned from the system generated frequencies.

11. The cover according to claim 8 wherein the angle of inclination of the plane of at least said first louvres with respect to the plane of said cover varies along the length of said first louvres.

12. The cover according to claim 8 wherein said first louvres are of uniform shape.

13. The cover according to claim 8 wherein said first louvres are longer than said second louvres.

14. A cover for a heat exchanger assembly, said assembly including a housing having a plurality of upstanding sides, a heat exchanger coil arranged in said housing, fan means for moving air over said coil and a motor for driving said fan means, said cover comprising:

a peripheral generally planar portion, an unbroken generally planar central portion, and a generally planar unbroken ring portion located intermediate said peripheral portion and central portion, said peripheral, central, and ring portions being generally coplanar;

a plurality of lengthwise radially oriented first louvres connecting said peripheral portion with said ring portion;

a plurality of lengthwise radially oriented second louvres connecting said central portion with said ring portion;

said peripheral portion, ring portion, and central portion and said pluralities of first and second louvres being formed from the same sheet, said first louvres being longer than said second louvres.

15. The cover according to claim 14 including a motor support bracket secured to said ring portion for supporting said fan driving motor.

16. The cover according to claim 15 wherein said cover and motor support bracket are detuned from the system generated frequencies.

17. The cover according to claim 14 wherein the angle of inclination of the plane of the first louvres with respect to the plane of the cover varies along the length of said first louvres.

18. The cover according to claim 14 wherein at least the first louvres are of uniform shape.

* * * * *